US005787945A

United States Patent [19]

Riemersma

[11] Patent Number: 5,787,945

[45] Date of Patent: Aug. 4, 1998

[54] BULK BAG SUPPORT FOR FILLING

[75] Inventor: Keith A. Riemersma, Holland, Mich.

[73] Assignee: National Bulk Equipment, Inc., Holland, Mich.

[21] Appl. No.: 643,951

[22] Filed: May 7, 1996

[51] Int. Cl.[6] ..... B65B 1/04

[52] U.S. Cl. ..... 141/314; 141/114; 248/100

[58] Field of Search ..... 141/10, 98, 114, 141/129, 90, 313, 314, 315, 316, 317; 248/100, 95, 99

[56] References Cited

U.S. PATENT DOCUMENTS

| | | | |
|---|---|---|---|
| 5,036,893 | 8/1991 | Decrane | 141/313 |
| 5,056,571 | 10/1991 | Derby | 141/10 |
| 5,259,425 | 11/1993 | Johnson | 141/10 |
| 5,348,063 | 9/1994 | Handleman | 141/10 |
| 5,400,837 | 3/1995 | Kelley et al. | 141/10 |

*Primary Examiner*—Henry J. Recla
*Assistant Examiner*—Steven O. Douglas
*Attorney, Agent, or Firm*—Flynn, Thiel, Boutell & Tanis, P.C.

[57] ABSTRACT

A bulk bag support for filling wherein the bulk bag has plural handles spaced around a top perimeter thereof. The support includes a frame and an elevatable mounting platform mounted on the frame. A plurality of spaced, openable and closeable support hooks are provided on the mounting platform and are selectively activatable for movement between opened and closed positions for selectively gripping and releasing the aforesaid handles. The support hooks, when in the closed position, releasably grip the handles thereby causing the bulk bag to be suspended from the support hooks and, when lifted, above a base member of the frame and to facilitate is filling of the bulk bag. When the support hooks are in the opened position, the handles on the bulk bag are thereby released causing the bulk bag to rest on the aforesaid base member. A yieldable biassing spring is provided for continually urging the support hooks toward the closed position.

16 Claims, 4 Drawing Sheets

BULK BAG SUPPORT FOR FILLING

FIELD OF THE INVENTION

This invention relates to a bulk bag support for filling and, more particularly, to a support mechanism for facilitating a loading of a bag thereon and removal of a bag therefrom.

BACKGROUND OF THE INVENTION

Large cardboard boxes, hereinafter referred to as "gaylords" have heretofore been used for supplying plastic pellets to consumers thereof, particularly, businesses that use plastic for forming various component parts made out of plastic. After a gaylord has become empty, it has usually been the procedure to reuse the cardboard boxes by collapsing them and shipping them back to the supplier of the plastic pellets. Recently there has been a move toward converting a supply of plastic pellets in gaylords to a supply in bulk bags. The bulk bags are generally easily collapsible for reuse. Further, the bulk bags can be lined with a liner so that the liner can be interposed between the product carried in the bulk bag and the bulk bag itself so as to prevent cross-contamination when new product is placed into a bulk bag that is in the process of being reused.

Loading of empty bulk bags onto an apparatus for facilitating a filling of the bulk bag has heretofore been somewhat complicated and has necessitated the bulk bag filling operators to position themselves in close proximity to filling apparatus thereby making the occupation of the operator somewhat dangerous. Bulk bag supports which will eliminate the need for an operator to place himself in a dangerous working position is desired.

Accordingly, it is an object of this invention to provide a bulk bag support wherein the bulk bag may be attached to the support from essentially a single location in front of the support out of harms way.

It is a further object of the invention to provide a bulk bag support, as aforesaid, wherein the support is movable to locations readily accessible by the bulk bag filling operator to thereby enhance the ability of the operator to manipulate the bulk bag from a single location in front of the support.

It is a further object of the invention to provide hook members on the bulk bag support that are readily manipulatable manually to facilitate loading and removal of bulk bags to and from the support.

It is a further object of the invention to provide a bulk bag support, as aforesaid, which is durable, relatively maintenance free and easy to operate.

SUMMARY OF THE INVENTION

The objects and purposes of this invention are met by providing a bulk bag support for filling wherein the bulk bag has plural handles spaced around a top perimeter thereof. The support includes a frame and a mounting platform mounted on the frame. A plurality of spaced, openable and closeable support means are provided on the mounting platform and are selectively activatable for movement between opened and closed positions for selectively gripping and releasing the aforesaid handles. The support, when in the closed position, releasably grips the handles thereby causing the bulk bag to be suspended from the support and above a base member of the frame and to facilitate filling of the bulk bag. When the support is in the opened position, the handles on the bulk bag are thereby released causing the bulk bag to rest on the aforesaid base member. A yieldable biassing means is provided for continually urging the support toward the closed position.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 1:
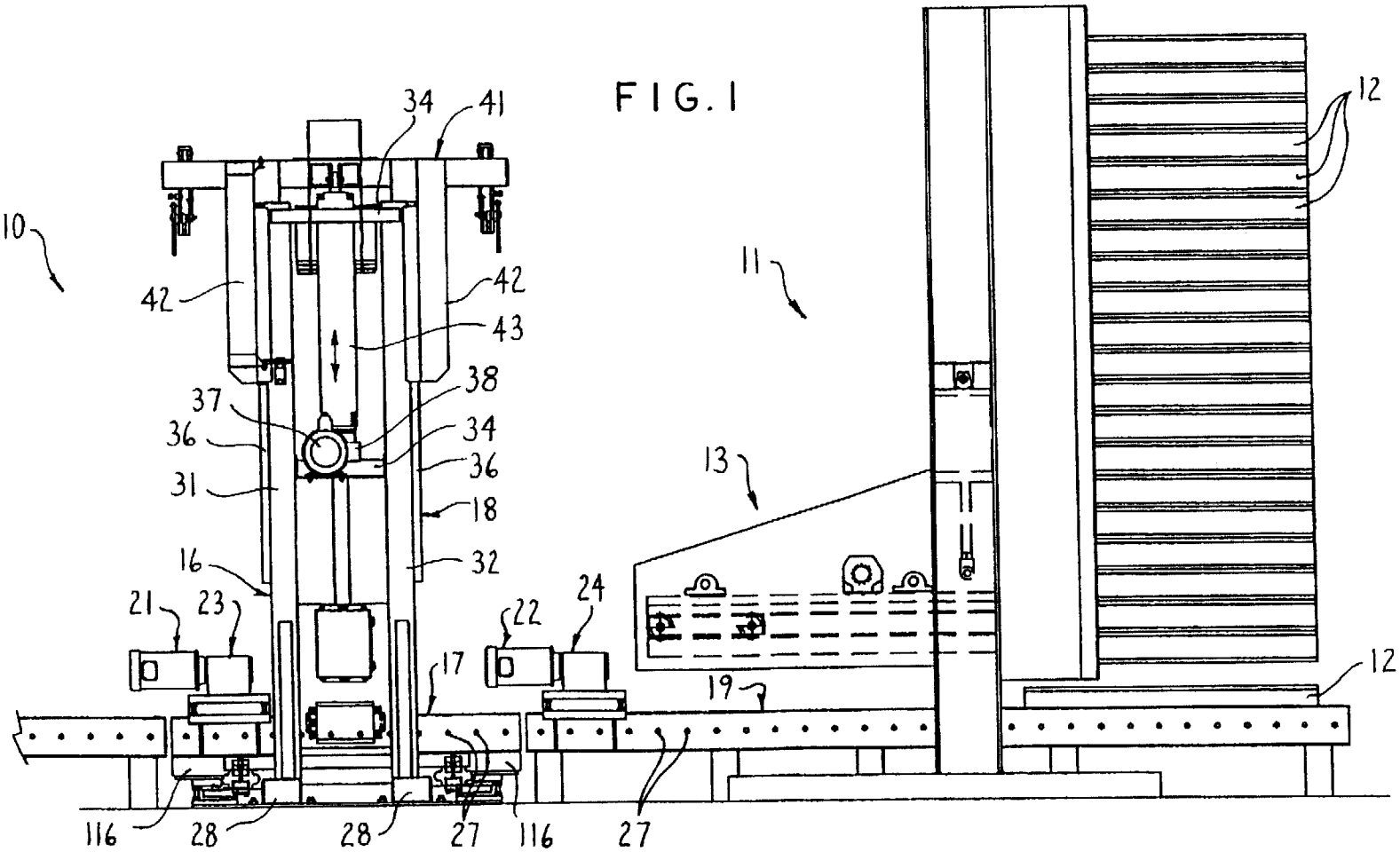
FIG. 1 is a side elevational view of a bulk bag support and pallet supply mechanism for supplying pallets one at a time to a position on the bulk bag support.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include derivatives and words of similar import.

A bulk bag support 10 is illustrated in FIG. 1 along side of an optional pallet supply mechanism 11 adapted to supply individual pallets 12 one at a time to the bulk bag support 10. A motor driven pallet selecting and dispensing mechanism 13 is utilized for effecting the one at a time delivery of a pallet 12 to the bulk bag support. The pallet supply mechanism 11 is a commercially available mechanism and, per se, does not form a part of the invention disclosed in this application. Thus, further detailed discussion concerning the pallet supply mechanism 11 will not be presented herein.

The bulk bag support 10 includes a frame 16 having a generally horizontally extending base structure 17 and a vertically upstanding column structure 18 juxtaposed the base structure. In this particular embodiment, the base structure 17 includes, as does a base structure 19 on the pallet supply mechanism 11, a plurality of parallel and horizontally arranged rotatable rollers. The respective rollers are driven by motors 21 and 22 through respective transmissions 23 and 24 provided on the base structures 17 and 18. The rollers are identified by the reference numeral 26 in FIG. 3, the axles 27 of which are illustrated in FIG. 1. In order to facilitate simultaneous rotation of the rollers or selected groups of rollers, the respective transmissions 23 and 24 can be interconnected with the individual rollers through conventional sprocket mechanisms 28 illustrated in FIG. 3. Conveyor mechanisms utilizing controlled sets of rollers for the purpose of conveying objects along a path are conventional and, accordingly, further discussion concerning the conveyor mechanism represented by the motors 21, 22, the transmissions 23, 24 and the rollers 26 will not be further detailed.

The base structure 17 also includes a set of floor mounted support bars 28 extending in a direction generally parallel to the longitudinal axes of the rollers 26. The support structure for the rollers 26 and the drive motor 21 and transmission therefor 23 are mounted on brackets 29 which in turn are support on the aforesaid support bars 28.

The aforesaid upstanding column structure 18 include, in this particular embodiment, a pair of spaced apart beams 31 and 32 individually supported in an upright position on the support bars 28. In this particular embodiment, each of the upstanding beams 31 and 32 is secured by appropriate gussets 33 to the support bars 28 along side of the longitudinal path defined by the plurality of parallel rollers 26. If desired, support braces 34 extending between the upstanding beams 31 and 32 can be provided in order to stabilize the upstanding column structure 18. A plurality of vertical guides 36 are provided on the upstanding column structure 18. In addition, a brace 34 oriented mid-height of the upstanding column structure 18 supports a drive motor 37 and a transmission 38 therefor. The transmission 38 includes a mechanism for converting the output of the drive motor 37 into a movement parallel to the vertical longitudinal axis of the upstanding column structure 18.

A mounting platform 41 is mounted on the upstanding column structure 18 and is supported for vertical movement with respect thereto. More specifically, the mounting platform includes a pair of vertically upright slides 42 that slidingly engage the vertical guides 36 to facilitate a guiding of the mounting platform vertically with respect to the upstanding column structure 18. A lift mechanism 43 is operatively driven by the transmission 38 and drive motor 37 to effect a driven movement of the mounting platform 41 in the aforesaid vertical direction. The lift mechanism 43 can include a rotating screw driven by the transmission 38 through a nut fixed to the mounting platform 41 or any other conventional drive mechanism for effecting an elevating and a lowering of the mounting platform 41 relative to the base structure 17.

Figures 2, 3:
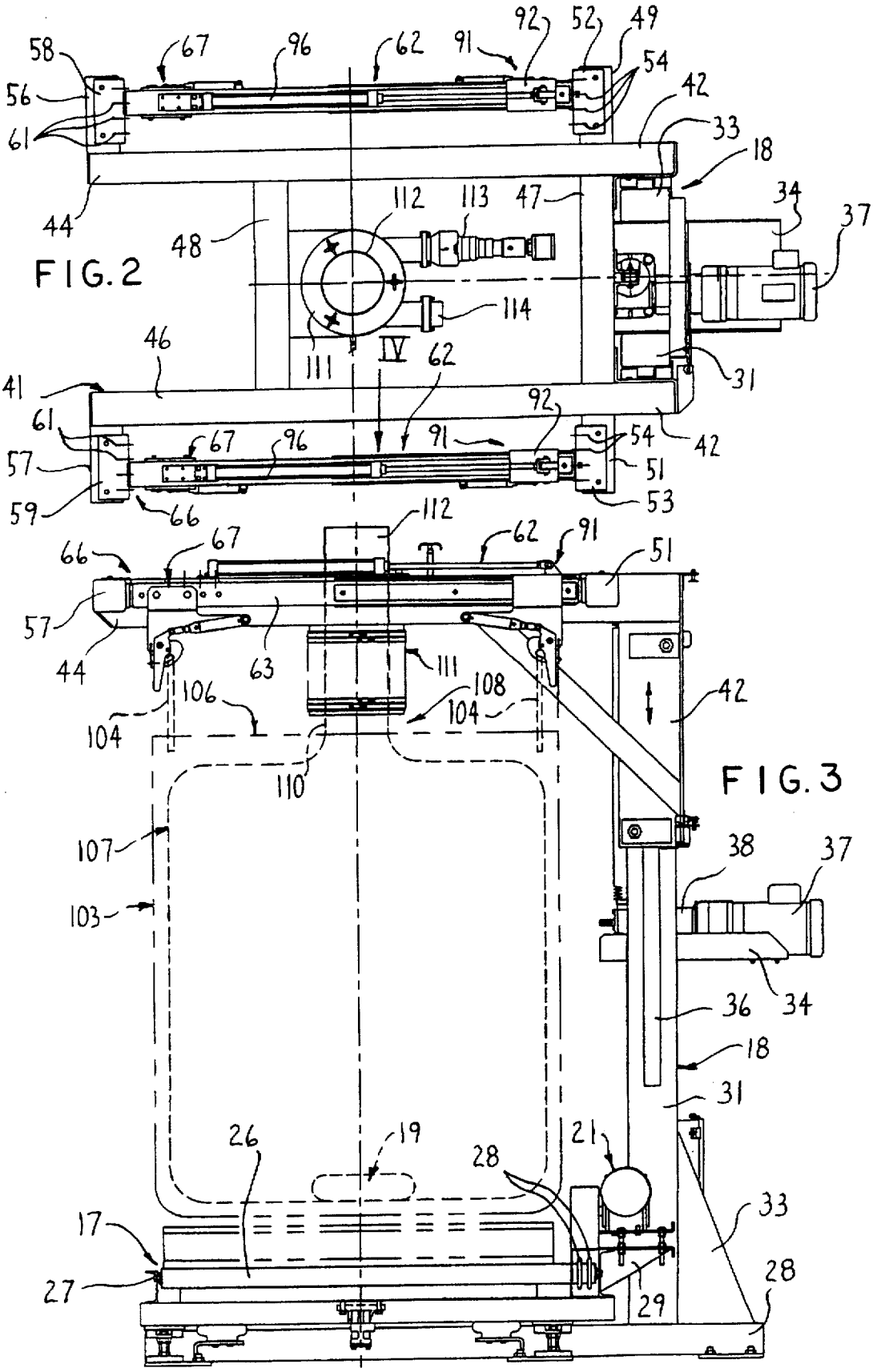
FIG. 2 is a top view of the bulk bag support embodying the invention.
FIG. 3 is a side elevational view of the bulk bag support.

The mounting platform 41 includes a pair of support arms 44 and 46 extending from the slides 42 to a position overlying the base structure 17 as illustrated in FIG. 3. Horizontally and laterally extending bracing 47 and 48 is connected to and extends between the support arms 44 and 46 to provide the requisite stabilization for the mounting platform 41. In this particular embodiment, extensions 49 and 51 are provided on a respective side of the support arms 44 and 46 which are remote from one another so as to provide a requisite location for a respective mounting bracket 52 and 53. Each mounting bracket 52 and 53 includes a plurality of slots 54 that extend vertically, are closed at the bottom and opened at the top and face outwardly in a first direction parallel to the longitudinal extent of the support arms 44 and 46. Further extensions 56 and 57 are provided on the support arms 44 and 46, but at an end of each thereof that is remote from the brace 47 and extensions 49 and 51. Mounting brackets 58 and 59, similar to the mounting brackets 52 and 53, are mounted on the extensions 56 and 57. Each of the mounting brackets 58 and 59 have a plurality of vertically extending slots 61 identical in kind to the slots 54, namely, they are closed at the bottom, opened at the top and face the slots 54. The slots 61 are, furthermore, aligned in a direction parallel to the longitudinal axis of the support arms 44 and 46 and with the slots 54.

An elongated support arm bracket 62 is mounted on each pair of opposing mounting brackets, 52, 58, and 53, 59. Each support arm bracket 62 includes an elongated bar 63 terminating at opposite ends in a pair of pins or a flat bar flange 64 receivable into the respective slots 54, 61 in each of the mounting brackets 52, 53, 58 and 59. As a result, the elongated bars 63 become oriented, when mounted on the mounting brackets 52, 53, 58 and 59 in an arrangement wherein the longitudinal axis thereof is parallel to the longitudinal axes of the support arms 44 and 46 and they overlie the rollers 26 on the base structure 17.

Figure 4:
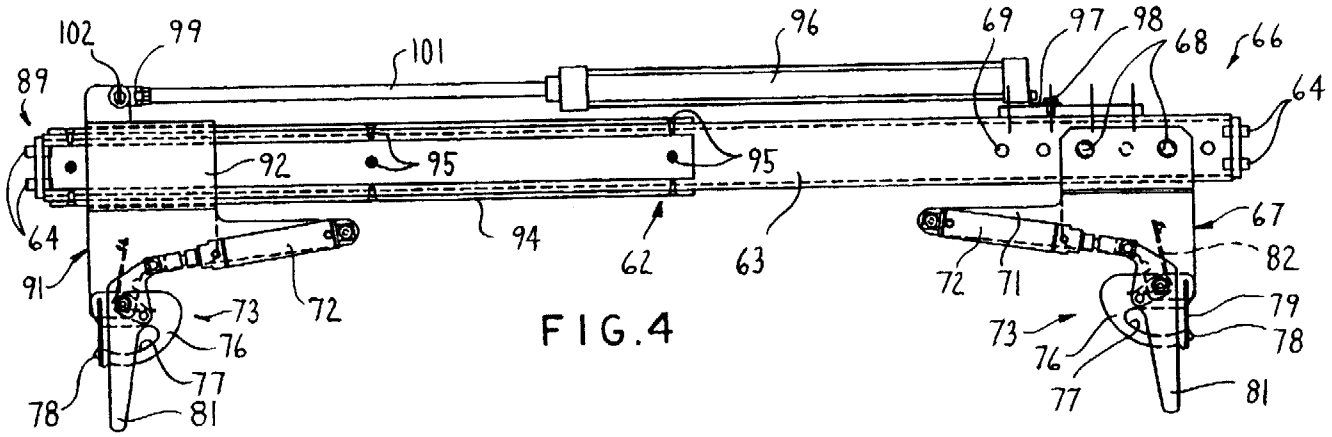
FIG. 4 is an enlarged fragment of FIG. 3 and illustrating a first embodiment of the support hooks.
Figure 8:
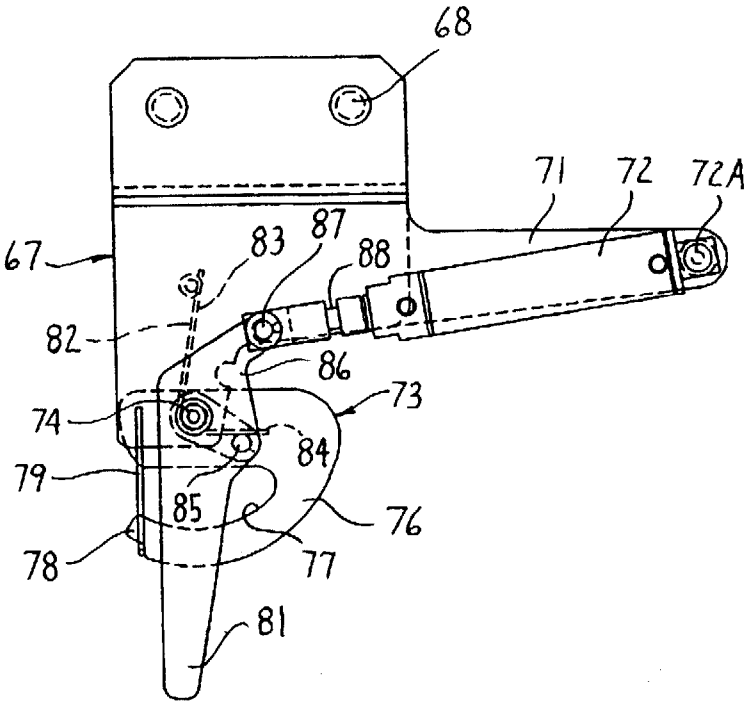
FIG. 8 is a side view of FIG. 7.
Figure 7:
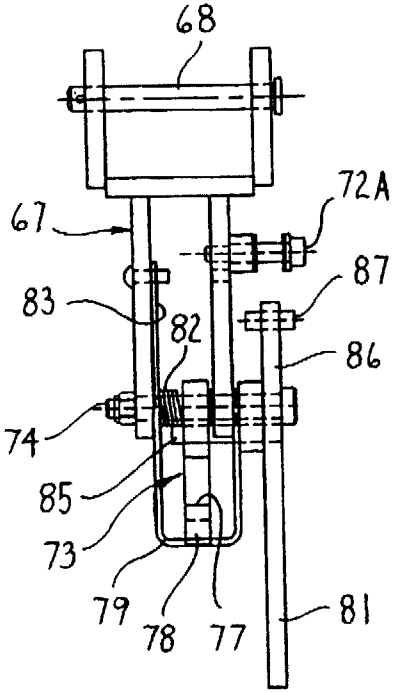
FIG. 7 is an end view of a bracket for a support hook.

FIG. 4 illustrates an enlargement of a first embodiment of the support arm brackets 62. This bracket is being viewed in the direction IV illustrated in FIG. 2. A first end 66 of the elongated bar 63 has a hook supporting bracket 67 fixedly secured thereto by a plurality of fasteners 68, such as bolts. A plurality of holes 69 in the elongated bar 63 are oriented in an array that extends parallel to the longitudinal axis of the elongated bar 63 to facilitate an orientation of the hook support bracket 67 at differing locations along the length of the elongated bar 63. As shown in FIG. 8, the bracket 67 includes a support extension 71 and a connector 72A for supporting one end of a pneumatically operated cylinder 72. The aforesaid connector 72A for connecting the pneumatic cylinder 72 to the support extension 71 renders that end of the cylinder pivotal with respect to the support extension.

The hook supporting bracket 67 also includes a hook mechanism 73 pivotally secured to the bracket 67 by means of an axle arrangement 74. The hook mechanism 73 includes a hook member 76 having an arcuately shaped, upwardly facing bulk bag handle engaging surface 77 having a distal end abutting a part 79 of the supporting bracket 67. The center of the arcuate handle engaging surface 77 coincides with a pivot axis defined by the axle arrangement 74 for the hook member 76. As a result, and when a weight force from a handle on the bulk bag is applied to the handles looped over the aforesaid handle engaging surface 77, the force will be transmitted through the axle 74 to the hook supporting bracket 67 and thence the support arm bracket 62.

A manually engageable lever 81 is connected to the hook member 76 and is pivotal therewith about the axle 74. A torsion spring 82 encircles the axle 74 with one leg 83 thereof being connected to the hook supporting bracket 67 and the other leg 84 thereof abutting against a pin 85 that is mounted on and movable with the hook member 76. The torsion spring 82 biases the hook member 76 to the closed position wherein the distal end 78 of the handle engaging surface 77 abuts the part 79 of the bracket 67 so that any bag handle supported on the surface 77 cannot be inadvertently released from the hook member 76.

The hook member 76 further includes an arm 86 that projects from the axle 74 on a side thereof remote from the lever 81 and is connected as at 87 via a pivot connection to the reciprocal rod part 88 of the pneumatic cylinder 72. Extension of the rod 88 from the pneumatic cylinder 72 in response to a pneumatic activation thereof will drive the hook member 76 from the closed position illustrated in FIG. 8 counterclockwise about the axle 74 to an opened position wherein the distal end 78 is positioned away from the part 79 of the bracket 67. Deactivating of the pneumatic cylinder 72 by the removal of air therefrom will cause the torsion spring 82 to drive the hook member 76 from the opened position to the closed position illustrated in FIG. 8.

Figure 9:
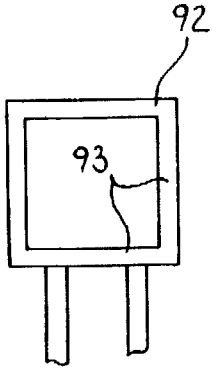
FIG. 9 is an end view of a modified support bracket for the support hook.

The elongated bar 63 at a second end 89 thereof includes a hook supporting bracket 91 that is slidably mounted on the elongated bar 63. To facilitate the sliding mounting, the bracket 91 includes a hollow support 92 (FIG. 9) that encircles the elongated bar 63 with the interior surfaces 93 thereof each engaging a low friction liner material 94, such as NYLON, TEFLON or the like secured to the exterior surface of the elongated bar 63 by a plurality of fasteners 95. A pneumatic cylinder 96 is secured to the elongated bar 63 by a bracket 97 and plural fasteners 98. The distal end 99 of the rod 101 of the cylinder 96 is secured to the hollow sleeve 92 of the hook supporting bracket 91 by a fastener 102. Extension and retraction of the rod 101 out of and into the pneumatic cylinder 96 will effect a sliding movement of the hollow sleeve 92 and thence the hook supporting bracket 91 lengthwise of the elongated bar 63.

The hook supporting bracket 91 includes a hook mechanism 73 identical to the hook mechanism provided on the hook supporting bracket 67. Thus, further comment about the construction of the hook mechanism is believed unnecessary.

It will be noted from a review of FIG. 4 that the distal ends 78 on the respective hook mechanisms 73 face away from each other. Thus, an operator standing near or adjacent the first end 66 of the elongated bar 63 will be able to reach the hook mechanism 73 on the bracket 91 when the rod 101 is retracted into the pneumatic cylinder 63 and, when the pneumatic cylinder 72 is activated to open the hook in a counterclockwise direction in FIG. 4 and expose the arcuately shaped, upwardly facing handle engaging surface 77, place a loop of the handle onto or over the open and exposed surface 77. Thereafter, the air supply to the pneumatic cylinder on the bracket 91 can be exhausted so that the torsion spring 82 will effect a closing of the hook member 76 to trap the handle on the hook member 76. Similarly, activation of the pneumatic cylinder 72 on the hook supporting bracket 67 at the first end 66 will cause the hook member 76 to pivot clockwise and open the arcuately shaped, upwardly facing handle engaging surface 77 to facilitate insertion of a handle thereon. If desired, manual manipulation of the respective handles 81 is permitted at all times when air pressure is not supplied to the pneumatic cylinders 72 so that the handles on the bulk bag can be removed or inserted without necessarily activating the pneumatic cylinders 72. In other words, and with the air supply off, the piston within each of the pneumatic cylinders 72 is free floating and it is only the respective torsion springs 82 that are maintaining the hook members 76 in the respective closed positions illustrated in FIG. 4.

Figure 5:
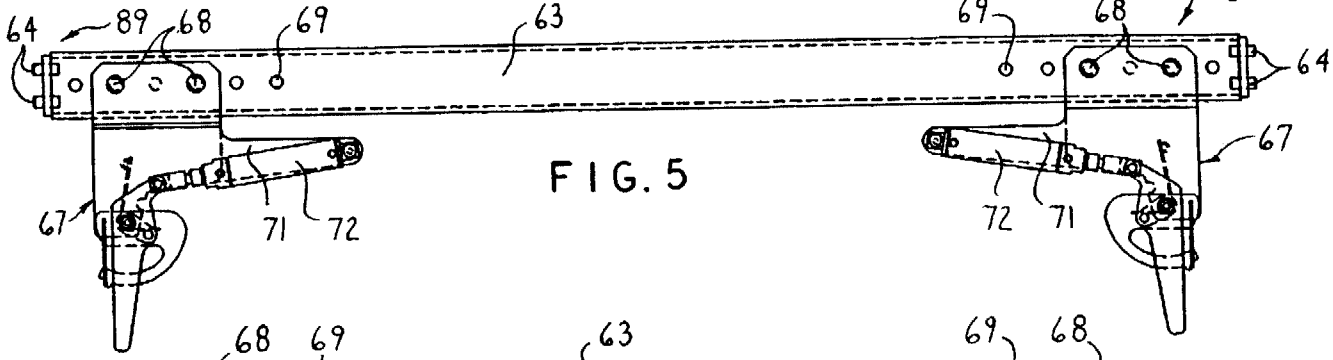
FIG. 5 is an enlarged fragment of FIG. 3, but illustrating a second embodiment of the support hooks.
Figure 6:
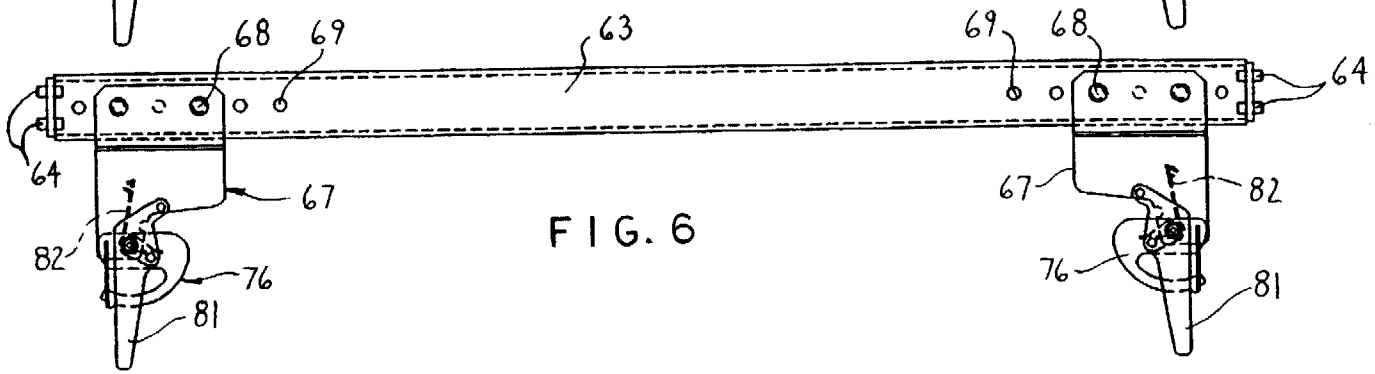
FIG. 6 is an enlarged fragment of FIG. 3, but illustrating a third embodiment of the support hooks.

The embodiments illustrated in FIGS. 5 and 6 are closely similar to the embodiment illustrated in FIG. 4. In FIG. 5, two hook supporting brackets 67 are mounted at the respective first and second ends 66 and 89 of the elongated bar 63 and are fastened thereto by plural fasteners, here bolts 68. In order to accommodate this construction, holes 69 are provided in the elongated support bar adjacent each of the first and second ends 66 and 89. FIG. 6, on the other hand, is similar in many respects to FIG. 5 except that there are no pneumatic cylinders corresponding to the pneumatic cylinders 72. In FIG. 6, the hook members 76 are movable only by manual engagement and manipulation of the levers 81 against the return force offered by the respective torsion springs 82. For convenience, the reference numeral 67 in FIG. 6 has been utilized to identify the hook supporting bracket 67 even though the bracket illustrated does not include the support extension 71.

As illustrated in FIG. 3, the bulk bag 103 includes a plurality of handles 104 thereon spaced around the top perimeter 106 of the bulk bag 103. A liner 107 is provided on the inside of the bulk bag 103. In this particular environment, both the bulk bag and the liner have an opening construction 108 at the upper end of both the bag and the liner and a further opening construction 109 at the bottom end of both the bulk bag 103 and the liner 107. However, the opening construction 109 in the fill phase is closed but readily accessible when, for example, the bag is lifted, to facilitate an opening thereof as during an unloading of the contents from inside the liner 107. When the opening construction 109 is closed, and the opening construction 108 is connected to a conventional collar mechanism 111 surrounding a fill pipe 112, contents such as plastic pellets can be introduced into the interior of the liner 107 through the fill pipe 112. The collar mechanism 111 is an inflatable bladder-type securement ring which entraps the neck 110 of the liner in a conventional manner so as to prevent spillage of the material being placed into the liner 107. If desired, air can be introduced into the bag 103 or liner 107 through an air intake 113 to inflate the bag 103 and liner 107 to minimize resistance to filling by the material of the bulk bag 103 and the liner 107. Any dust that may exist during the filling process can be removed through a dust collecting outlet 114. If desire d, the dust collecting outlet can be connected to an exhaust system and a dust bag associated therewith.

In use, a bag 103 and, if used, a liner 107 can be held lifted from the rollers 26 and/or a pallet 12 during filling. During filling, the bag 103 can be lowered by operation of the motor 37, transmission 38 and lift mechanism 43 so that the bottom of the bag 103 rests on the rollers 26 or, if used, a pallet 12 or weighing device 116 and the tautness of the handles is diminished, so that they can be each released from the respective hook members 76. The hook member 76 at the second ends 89 of each elongated bar 63 is made particularly convenient to the operator when the respective hook supporting bracket 91 is movable toward the operator located adjacent the first ends 66.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A bulk bag support for filling, said bag having at least a bottom wall extending upwardly from a perimeter of the bottom wall and a sidewall terminating in a top perimeter and plural handles spaced around the top perimeter, comprising:

a frame, said frame including a ground engaging base adapted to engage the bottom wall and support the bulk bag during and after a filling thereof and an upstanding column;

a mounting platform on said frame and overlying said base;

a plurality of spaced support means on said mounting platform, each of said support means including selectively actuable means supported for movement between first and second positions for respectively selectively gripping and releasing said handles, said selectively actuable means, when in the first position, non-releasably gripping said handles thereby causing said bulk bag to be suspended from said support means and above said base for filling and, when in the second position, releasing said handles thereby causing said bulk bag to rest on said base, wherein said selectively actuable means includes a bracket mounted on said mounting platform and a hook member pivotally mounted on said bracket and adapted to grippingly engage and release said handles, said hook member including an arcuately shaped, upwardly facing handle engaging surface having a distal end juxtaposed said bracket when said selectively actuable means is in the first position to thereby prevent the handle passing therebetween, a center of said arcuate handle engaging surface approximating a pivot axis for said hook member so that when a weight force from said bulk bag is applied to the handles, a theoretical vector of the force will be transmitted through said bracket adjacent said pivot axis; and yieldable biassing means for continually urging said selectively actuable means toward said first position.

2. The bulk bag support according to claim 1, wherein said base includes a plurality of parallel, rotatably supported rollers thereby defining a conveyor and a pallet supply means for supplying a pallet onto said rollers so that said pallet is interposed between the bottom wall of the bag and said rollers.

3. The bulk bag support according to claim 2, wherein selected ones of said rollers are motor driven for rotation.

4. The bulk bag support according to claim 2, wherein said pallet supply means includes a stacked pallet support and selectively operable dispensing means for selectively dispensing one pallet at a time onto said rollers.

5. The bulk bag support according to claim 1, wherein said mounting platform and said column have means thereon for facilitating relative movement therebetween for accommodating bulk bags of differing height.

6. The bulk bag support according to claim 1, wherein the center for said arcuate handle engaging surface coincides with said pivot axis, and wherein the theoretical vector will be transmitted through said pivot axis.

7. The bulk bag support according to claim 1, wherein each said bracket includes an elongated support bar of finite length and fastening means for fastening said support bar to said mounting platform.

8. The bulk bag support according to claim 7, wherein a pair of said support bars are mounted in parallel relation on said mounting platform, and wherein a pair of said brackets are secured to each of said support bars adjacent opposite ends thereof.

9. The bulk bag support according to claim 8, wherein each said hook member pivotally mounted on each bracket includes a lever arm extending radially from said pivot axis.

10. The bulk bag support according to claim 9, wherein said selectively actuable means is interposed between said bracket and said lever arm for facilitating a driven movement of said hook member about said pivot axis, whereby the distal end of said arcuate handle engaging surface becomes spaced from said bracket to allow the handle to pass therebetween and wherein said yieldable biassing means is a torsion spring encircling said pivot axis with one leg thereof fastened to said lever arm and an other leg thereof fastened to said bracket.

11. The bulk bag support according to claim 8, wherein each said hook member pivotally mounted on each bracket includes first and second lever arms extending radially from said pivot axis, wherein said first lever arm includes a manually engageable handle for facilitating a manual urging of said hook member against the urging of said yieldable biassing means, wherein said bracket further includes said selectively actuable means interposed between said bracket and said second lever arm for facilitating a driven movement of said hook member about said pivot axis, whereby the distal end of said arcuate handle engaging surface becomes spaced from said bracket to allow the handle to pass therebetween, and wherein said yieldable biassing means is a torsion spring encircling said pivot axis with one leg thereof fastened to said second lever arm and an other leg thereof fastened to said bracket.

12. The bulk bag support according to claim 11, wherein each hook member opens in oppositely facing directions.

13. The bulk bag support according to claim 11, wherein said plurality of support means is each laterally adjustable on said mounting platform in order to accommodate different sized bulk bags.

14. The bulk bag support according to claim 1, wherein said mounting platform includes means for inflating said bulk bag.

15. The bulk bag support according to claim 1, wherein said mounting platform includes dust collector means for collecting dust emitted by said bulk bag.

16. The bulk bag support according to claim 1, wherein said mounting platform includes adjusting means for facilitating adjustment of said support means longitudinally thereof.

* * * * *